US009322156B2

(12) United States Patent
McInnis et al.

(10) Patent No.: US 9,322,156 B2
(45) Date of Patent: Apr. 26, 2016

(54) EXTERNALLY INSTALLABLE CURB INLET CATCH BASIN FILTRATION APPARATUS

(71) Applicants: Stephen J. McInnis, Portland, OR (US); Matthew Moulton, Portland, OR (US)

(72) Inventors: Stephen J. McInnis, Portland, OR (US); Matthew Moulton, Portland, OR (US)

(73) Assignee: Clean Way Services, Inc., Portland, OR (US)

( * ) Notice: Subject to any disclaimer, the term of this patent is extended or adjusted under 35 U.S.C. 154(b) by 163 days.

(21) Appl. No.: 14/181,060

(22) Filed: Feb. 14, 2014

(65) Prior Publication Data

US 2014/0238915 A1 Aug. 28, 2014

Related U.S. Application Data

(60) Provisional application No. 61/767,926, filed on Feb. 22, 2013.

(51) Int. Cl.

| | |
|---|---|
| ***E03F 5/04*** | (2006.01) |
| ***B65D 43/02*** | (2006.01) |
| ***E02D 29/14*** | (2006.01) |
| ***E03F 5/046*** | (2006.01) |

(52) U.S. Cl.

CPC ..... *E03F 5/0404* (2013.01); *B65D 43/022* (2013.01); *E02D 29/1427* (2013.01); *E03F 5/0403* (2013.01); *E03F 5/046* (2013.01)

(58) Field of Classification Search

CPC .... E03F 5/0404; E03F 5/046; E02D 29/1427; B65D 43/022

USPC ..... 210/162, 163, 164, 170.03, 232, 747.3; 404/4, 5, 25; 220/789

See application file for complete search history.

(56) References Cited

U.S. PATENT DOCUMENTS

| | | | | |
|---|---|---|---|---|
| 5,232,587 | A * | 8/1993 | Hegemier | E03F 5/046 210/162 |
| 5,405,539 | A * | 4/1995 | Schneider | E03F 5/0404 210/163 |
| 5,643,445 | A * | 7/1997 | Billias | E03F 5/0404 210/162 |
| 6,254,770 | B1 * | 7/2001 | Remon | E03F 5/0404 210/163 |
| 6,884,343 | B2 * | 4/2005 | Harris | E03F 5/0404 210/163 |
| 7,670,483 | B2 * | 3/2010 | Ringenbach | E03F 5/0404 210/163 |
| 8,343,357 | B2 * | 1/2013 | Horner | E03F 5/0404 210/162 |
| 8,608,956 | B2 * | 12/2013 | Moulton | E03F 5/0404 210/163 |
| 2005/0183997 | A1 * | 8/2005 | Happel | E03F 5/0404 210/163 |
| 2011/0155672 | A1 * | 6/2011 | McInnis | E03F 5/0404 210/163 |

* cited by examiner

*Primary Examiner* — Christopher Upton
(74) *Attorney, Agent, or Firm* — Hancock Hughey LLP

(57) ABSTRACT

A filtration apparatus for curb vaults may be installed in existing vaults through the road-level inlet opening into the vault. A support plate assembly of the filtration apparatus suspends a primary and secondary filter and is movable between extended and retracted positions. An adjustable attachment system allows installation of the filtration apparatus by inserting the apparatus through the inlet opening.

20 Claims, 11 Drawing Sheets

EXTERNALLY INSTALLABLE CURB INLET CATCH BASIN FILTRATION APPARATUS

FIELD OF THE INVENTION

This invention relates to a filtration apparatus for surface water, and more specifically to a filtration apparatus for removing sediment and other contaminants from surface water and adapted for insertion into existing curb inlet catch basins.

BACKGROUND

Surface water run-off is coming under increased scrutiny as a source of pollutants entering ground water, streams and rivers. As water from rain or snow melt and other sources flows over the surface of the ground it picks up a wide variety of pollutants, ranging from large and small debris, suspended solids and sediment to oils and other soluble and insoluble chemical contaminants. Because surface water is relatively easily contained through storm sewers and dry wells, many agencies at all levels of the government are paying increased attention to both the contaminants that enter the water system through surface water run-off, and to methods to control and eliminate such contaminants. Moreover, governmental regulations currently in place put restrictions on the amount of sediment that can be permitted to flow into sewer systems.

A municipal storm sewer system is one type of traditional surface water filtering system. In this type of system a series of catch basins or collection boxes are interconnected with sewer pipe. Surface water flows into the catch basin, often a relatively narrow un-grated inlet opening—the opening is often 4 inches or less in height. The water that flows into the opening enters the catch basin, which is a collection box or vault that functions essentially as a settling basin. Such collection boxes are sometimes called sump tanks. Some sediment that flows into the system settles to the bottom of the basin, and the water flows through an outlet pipe and into the sewer system and, depending upon the system, either to another processing facility or directly into a stream or river.

This traditional system is useful as a primary control system, and is relatively inexpensive, but it has many problems. As examples of the problems, the catch basin can quickly be filled with sediment if the water contains a high level of solids or sediment, causing the catch basin to become filled and the system to overflow or become clogged. Because the catch basin is typically a cylindrical tube or a rectangular box that sits below grade level, cleaning the sediment out of the basin can be a difficult job. Cleaning is made much more difficult if the system is clogged and the basin is underwater. Just as important, the system does not stop all of the sediment and other pollutants in the run-off. Typically, the water flow through the basin is fairly turbulent, especially when there is a lot of water flowing through the system, for instance during a storm. When this occurs very little sediment settles out, and is instead washed through the basin and into the sewer system. This may result in non-compliance with governmental regulations, possibly resulting in fines. Finally, a typical catch basin system does nothing to collect oils and other chemical contaminants and dissolved solids.

The grated catch basin type of system is routinely used with both private and municipal systems. In a dry well the surface water that flows through the sump tanks flows into a dry well associated with one or more basins rather than flowing into a municipal or other sewer system. However, to function properly, dry wells must have sufficient flow-through characteristics. Water containing a high level of sediment can quickly clog a dry well by stopping water flow-through. And as noted above, a grated catch basin does not stop oils and other chemicals. These kinds of pollutants, and especially oils that flow through the system can clog dry wells very quickly. Commercial dry wells can be very large, especially if they are used to contain run-off from a large area such as a large private parking lot, and are connected to numerous catch basins. It is typically very expensive to dig a new dry well, or to unclog an existing well.

As noted, many government agencies are paying increased attention to contaminants that are carried into streams and rivers in surface water run-off. Because polluted surface water run-off can be a significant source of pollution, agencies have begun to monitor the levels of contaminants in run-off, both in municipal and private systems. In the past several years, many municipalities have begun to impose fees on catch basin users, whether the catch basin is connected to a storm sewer system or a dry well. While these fees apply in most instances to commercial users, they can also apply to residential systems. In large part the fees are based in some manner on the kind and amount of pollutants that flow through the catch basin and into the system. In general, the higher the level of contaminants flowing through the system, the higher the fee. In some cases the amount of the fee is based on the kind of contaminant. For example, oils flowing into a sewer or dry well can lead to increased fees. These fees even apply to private commercial dry well users, since it is in the interest of a municipality to control the amount of pollution that enters the ground water.

There is therefore a strong incentive to decreasing both the amount and kind of contaminants flowing through a catch basin and into either a municipal sewer system or a private dry well or sewer system. First, there is an obvious environmental incentive: by decreasing contamination of all kinds from surface water run-off, the water that flows back into the ground and into streams and rivers is cleaner. This helps to improve environmental conditions in numerous ways. Second, there is a strong economic incentive: when sewer system and dry well users are paying fees based on the amount and kind of contaminants that flow into their systems, it is of obvious advantage to minimize all contaminants. Further, the costs associated with either cleaning catch basins or reconditioning dry wells are substantial. Avoiding or delaying those costs by reducing the amount of contaminants flowing through the system can save substantial amounts of money.

Curb-inlet catch basins are ubiquitous and are one type of vault used in storm sewer systems and functions the same as the systems described above. However, a curb-inlet catch basin is located along side roadways, typically those that are either paved with asphalt or which are concrete. Water flows off the roadway and enters the catch basin through an opening formed in a roadside curb. While there are numerous different designs for curb-inlet systems, a typical system has a below-grade vault made of reinforced concrete and which is connected to the sewer system through pipes. The vault is generally a square or rectangular box, the upper edge of which is typically at or near the same elevation as the roadway. A square riser or lid that is the same size as the vault and which also is typically concrete sits atop the vault. The riser is typically the height of the curb. A top unit typically sits atop the riser and defines a plate that rests on the riser and covers the vault. The top unit has a removable manhole cover, almost always round, which allows access to the vault for maintenance. Often, the lid is a one piece unit that covers the vault and has a manhole that provides access to the interior of the vault.

Curb-inlet systems present the same problems as the other systems described above and it is therefore desirable to filter water that flows into the systems. However, curb-inlet systems present unique challenges since the manhole access covers are typically round and the vaults beneath the covers are typically square and because the lid that covers the vault typically cannot be removed once it is in place, at least not without a significant amount of work involving equipment able to lift very heavy concrete structures (i.e., the lid). And in cases where the manhole access cover is other than round, the access plate to the underlying structures is typically smaller in size than the vault below the access plate. It is very difficult therefore to retrofit a filter system that easily fits through the round manhole cover and securely attaches to the vault. As a result, installation of conventional filtering systems is made very difficult; often the entire top unit has to be removed and a significant amount of labor is required to install the filter system.

There is a need therefore for a filter system that may be easily installed in existing curb-inlet catch basins.

SUMMARY

The curb-inlet catch basin filtration system of the present invention is designed to be installed in existing curb-inlet catch basins that are in turn attached to existing municipal separate storm sewers and dry well systems and other storm water treatment systems, such as swales and infiltration ponds. The system of the present invention comprises a filter support plate that may be installed in a vault through the opening into the vault at the curb. Once the filter support plate is installed through the curb inlet, a filter system may be installed through the manhole. With the present system, the entire filter system may be installed in a vault without the need for workers to enter the vault. In other words, the workers need not climb into the vault at all; the entire system may be installed with workers remaining outside of the vault.

The filter support plate has a low profile that allows it to be inserted into the vault through the curb inlet. The plate is initially supported in the vault with one end resting on an interior ledge that is installed prior to insertion of the plate, and the other, street-side end suspended by a suspension bar. Adjustable jack bolts are attached to the support plate and secure the plate to the interior of the catch basin so that the platform is totally self-supported in the catch basin.

The support plate includes a retractable portion having an opening for suspending a primary and secondary filter system—the opening is positioned such that it lies directly below the manhole cover. Run-off flowing into the system preferably must pass through a flow path defined by the support plate and into filters as described herein. The inlet into the catch basin through the curb is a traditional inlet opening, which as noted is typically quite narrow in the height dimension, often 4 inches or less. Water flows onto the support plate and is directed into a primary filter, which is defined by a cylindrical perforate screen that has an open upper end and a perforate screen on the lower end; this filter traps solids that flow past the inlet opening. The screen is rigid or semi-rigid and optionally may be used to support an optional secondary filter. A cylindrical filter surrounds the perforate screen on the sides and bottom and the water passes through this secondary filter. The secondary filter comprises a non-woven sediment filter that optionally includes media contained in the filter. When media is incorporated into the secondary filter, the media selected for this secondary filter depends upon the conditions encountered at a specific location. The media may be specific to absorb oils and petrochemicals, as might be expected in run-off from parking lots. Similarly, oils are often contained in run-off from food processing facilities. Other types of media for removing other contaminants may also be used.

The portion of the support plate from which the primary and secondary filters are suspended is retractable both when the filters are installed and when the filters are removed. This allows access to the interior of the vault without removing either the primary or secondary filters. When the vault needs to be cleaned, the manhole cover is removed to allow workers to have access to the interior of the vault. The workers may either remove the primary and secondary filters or leave them in place if they do not require servicing. In either case, when the retractable portion of the support plate is retracted, the interior of the vault is exposed. A Vactor unit may then clean out the vault as usual before reinstalling the primary and secondary filters as the case may be. It will be appreciated that if the primary and secondary filters are removed, the workers will also have access to the interior of the vault through the opening in which the filters are suspended, even without retracting the support plate.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION

The invention will now be described in detail with reference to the drawings. It will be understood that relative directional terms are used at times to describe components of the invention and relative positions of the components. As a naming convention, the plane of the ground, for example, in FIG. 1A, the surface of the road surface 102 is considered to be a generally horizontal surface. Directional terms correspond to this assumedly horizontal plane: "upper" refers to the direction above and away from the road surface; "lower" is generally in the opposite direction, "inward" is the direction from the exterior of the vault in which the invention is installed toward the interior of the vault, "vertical" is the direction normal to the plane of the road surface, and so on.

Figure 1A:
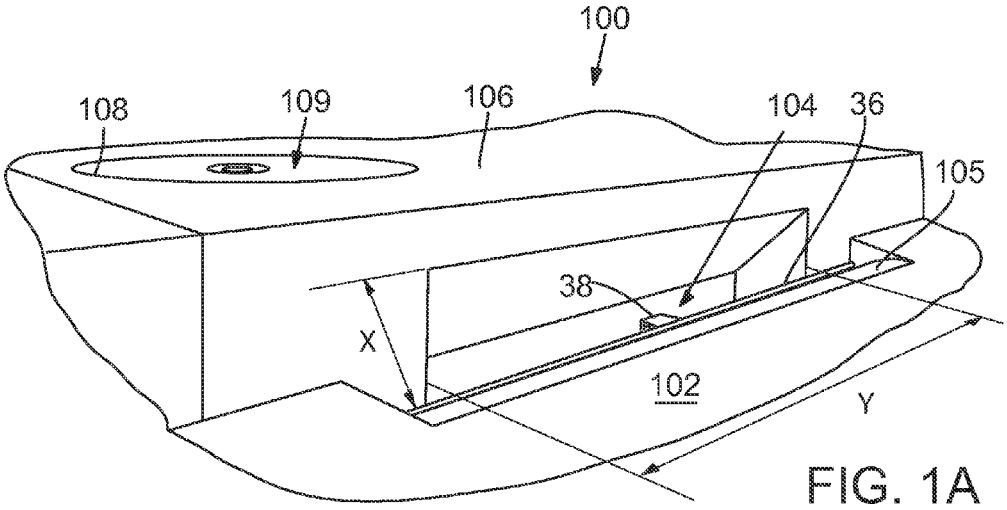
FIG. 1A is a street level perspective view of an first conventional type of existing curb-inlet vault of the type that the filtration apparatus of the present invention may be used.
Figure 1B:
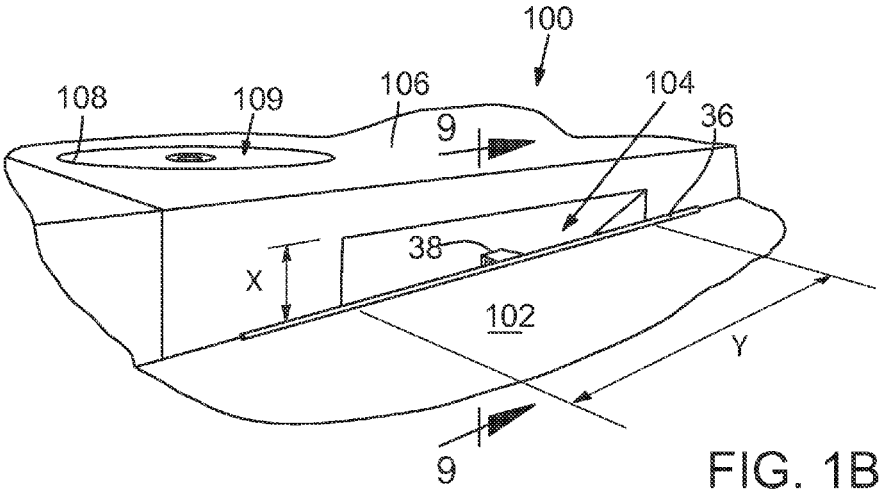
FIG. 1B is a street level perspective view similar to FIG. 1, but illustrating a second conventional type of existing curb-inlet vault of the type that the filtration apparatus of the present invention may be used

FIGS. 1A and 1B illustrate the general environment in which the filtration apparatus of the invention is typically used, and more specifically, two types of curb-inlet vault filters that are fairly typical. The vault is generally identified with reference number 100 and is an existing in-ground structure. For context, and with reference to FIGS. 1A and 1B, filtration apparatus 10 of the present invention is adapted for installation in existing curb-side sewer vaults, which as noted is identified generally with reference number 100. A curb-side sewer vault 100 is installed at the side of a roadway at an elevation such that water running off a road surface 102 flows from the road surface into an opening 104 into the pre-existing vault 100 that defines a basin that is located below the grade of the road surface 102. There are numerous kinds of catch basins that are used for vaults such as vault 100. Most typically, vault 100 is a square or rectangular box-like structure made of precast concrete and having a top capped with a very heavy lid 106, the top surface of which typically defines a portion of the sidewalk and which has a manhole opening 108 that is closed with a removable manhole cover 109. The manhole 108 provides an opening through the sidewalk into the interior of vault 100 and as noted, a removable manhole cover closes manhole 108. Most manholes 108 are round and most manhole covers 109 are therefore also round. However, manhole covers may be found in many different configurations. In the case of a round manhole, the access dimension into the interior of the underlying vault is defined as the diameter of the round opening. Where the manhole is some other shape, for instance square or rectangular, the access dimension is the length of the longest diagonal between corners of the opening.

The difference between FIGS. 1A and 1B is in the entrance into the vault at opening 104. In FIG. 1A the road surface 102 is sloped downwardly at 105 so that water flowing from the road is channeled into the opening 104. In FIG. 1B the road surface is relatively flat leading into opening 104. Both types of openings are standard.

Figure 9:
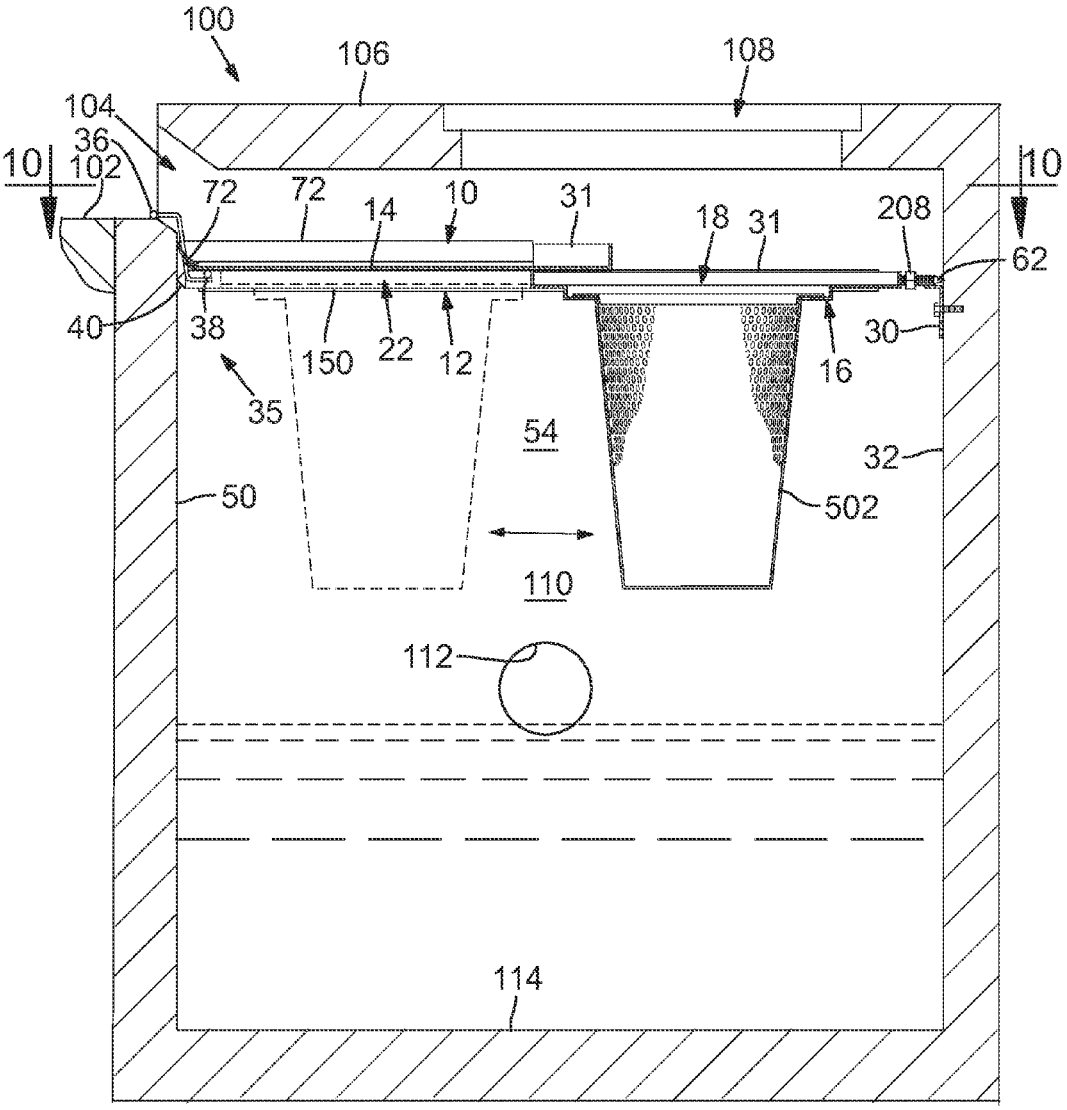
FIG. 9 is a cross sectional view taken along the line 9-9 of FIG. 1B and illustrating the filtration apparatus according to the present invention installed in an existing vault and showing the apparatus in extended and retracted positions.

As shown in several of the figures and perhaps best shown in the cross sectional view of FIG. 9, the vault 100 has an open interior 110 and an outlet 112 that is connected to the storm sewer system. Water flowing from the roadway 102 enters vault 100 through inlet 104, flows into the open interior 110 and exits through outlet 112. Since the outlet 112 is positioned above the floor 114 of vault 100, the vault acts as a settling basin where solids may settle out and collect while water flows through outlet 112. The vault is cleaned by accessing open interior 100 through the manhole 108 and using conventional manual or machine cleaning techniques.

The inlet 104 into the vault 100 is typically a fairly restricted opening—a dimension of 4 inches in height by 48 inches in width is typical although there is no "standard" inlet opening dimension and there are a wide variety of inlet opening dimensions used. In any case, for purposes herein, the height dimension of the un-grated inlet opening 104 is defined as X and the width dimension is Y as illustrated in FIGS. 1A and 1B.

Figure 7:
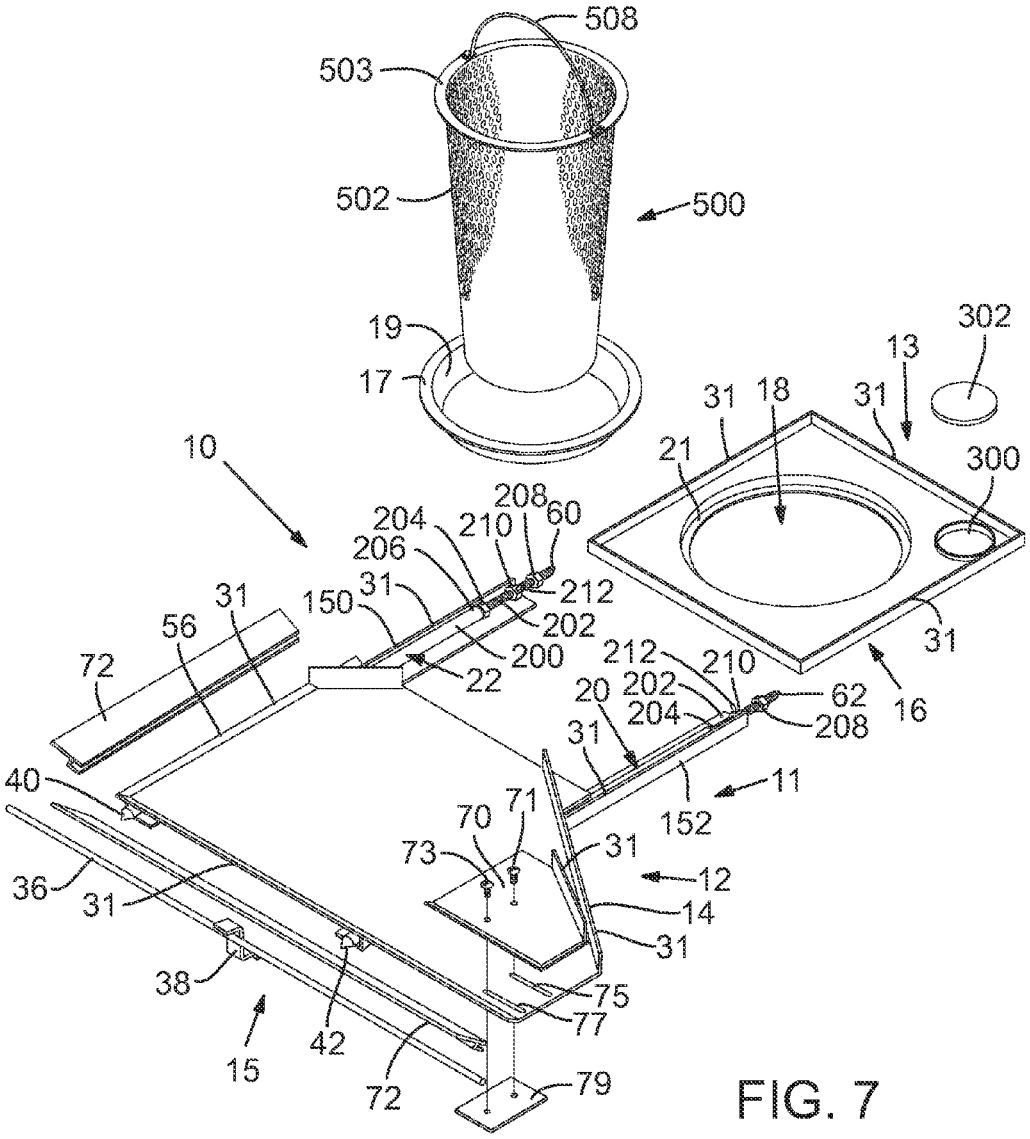
FIG. 7 is a perspective and exploded view of the filtration apparatus showing the components of the present invention.

Reference is now made to FIG. 7, which is a perspective and exploded view of filtration apparatus 10 shown with some of the various components. Apparatus 10 is defined by a support plate referred to generally at 11 and which is sized such that it fits into the interior of the vault 100. Thus, the height dimension of the support plate 11 is always less than X, and the width of the support plate (at least initially, before it is widened after installation as described below) is less than Y. Support plate 11 is defined by a first plate section 12 that has an angled wall section 14, a second plate section 16 that has an opening 18, and a suspension system that is defined by adjustable jack bolts 20 and 22 that as described below are adjusted to secure edge 13 of plate 11 to the interior walls of the vault and a suspension rod 36 that supports edge 15 of plate 11—that is, the edge of plate 11 that is nearest the roadway. Second plate section 16 is retractable between a first extended position and a second, retracted position as detailed below. In addition, the filter components are suspended on second plate section 16 of plate 11 through opening 18 in second plate section 16. Opening 18 opens into the open interior 110 of vault 100. All peripheral edges of the plate 11 have an upwardly extending lip 31 so that water flowing into the inlet 104 flows onto plate 11 in the flow path described below and shown with arrows A—the upwardly projecting lip 31 channels water flow to the opening 18 (and thus to the filter components described below). But as may be seen in FIGS. 8 and 10 with arrow B, the angled wall section 14 opens directly into open interior 110 of vault 10. That is, water that flows over upwardly projecting lip 31 at the angled wall section 14 flows directly into the open interior 110 without passing through filter components that are suspended through opening 18. Arrow B thus defines an overflow condition path: if the volume of water flowing through inlet 104 exceeds the capacity of water flow through the normal flow path A, then excess water flows (unfiltered) into vault 10's opening interior 110 over the edge of plate 11 at angled edge portion 14, over lip 31, as shown with arrow B.

Figure 2:
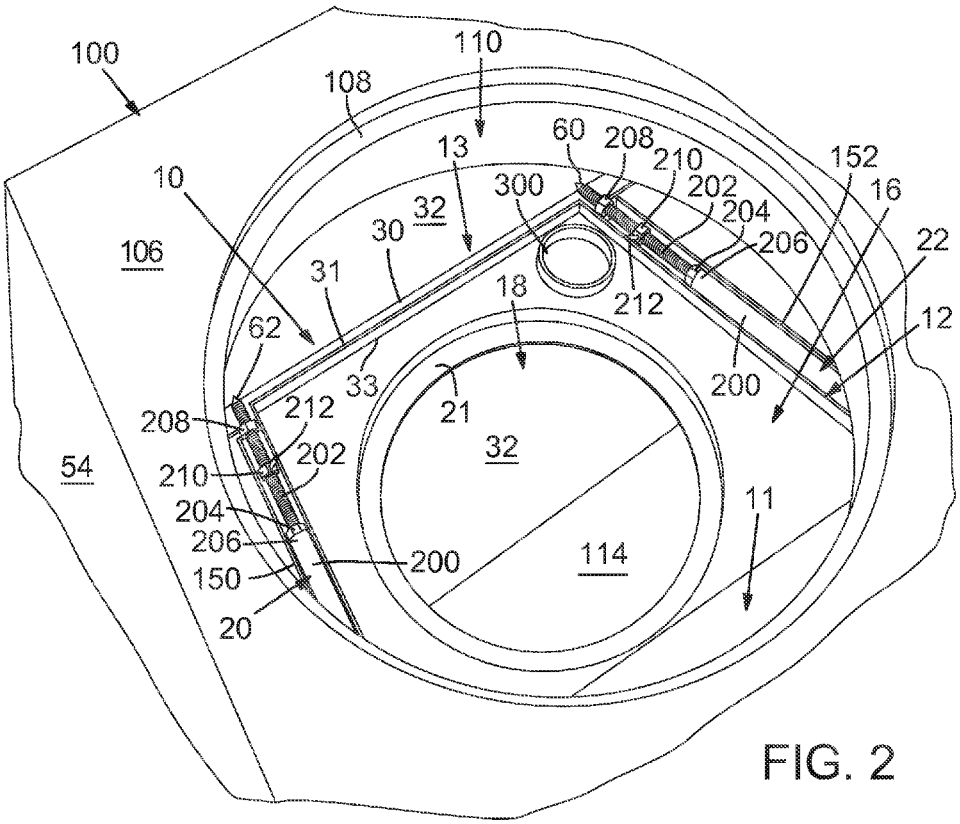
FIG. 2 is an upper perspective view taken through a manhole opening and illustrating a portion of the filtration apparatus according to the present invention installed in the interior of the vault.

FIG. 2 is a close up taken from above the vault through manhole 108. As may be seen, support plate 11 is oriented in the interior of the vault such that opening 18 through plate section 16 is positioned directly below the manhole opening 108. In FIG. 2, jack bolt 20 is seen to be defined by a tube 200 into which a threaded rod 202 is inserted. A nut 204 is fixed to the inlet 206 of tube 200. A second nut 208 is fixed to threaded rod 202 near distal end 62 (i.e., by welding the nut 208 to the rod). As such, when nut 208 is rotated, the distal end 62 may be driven longitudinally both ways to either drive the distal end 62 into wall 32 (and simultaneously, drive the opposite end of the jack bolt—proximal end 40, FIG. 6—into the opposite wall 50) to secure the plate 11 in place. The plate may be loosened by retracting the jack bolts by rotating nut 208 the opposite direction. A stop nut 210 is also threaded onto rod 202 and its purpose is detailed below. The second adjustable jack bolt 22 is identical to jack bolt 20 both in structure and function.

Also visible in FIG. 2 is a test port 300, which includes a removable cap 302 (see FIGS. 7 and 8) which allows access to the open interior 110 of vault 100 to allow sampling of water that has flowed through the filter apparatus, without moving the second plate 16 away from wall 32. With reference to the series of drawing of FIG. 8A through 8E, the cap 302 is specifically designed to remain in place covering test port 300 until the cap is affirmatively removed. This prevents the cap from being removed when a Vactor truck is vacuuming out the vault.

Figure 8:
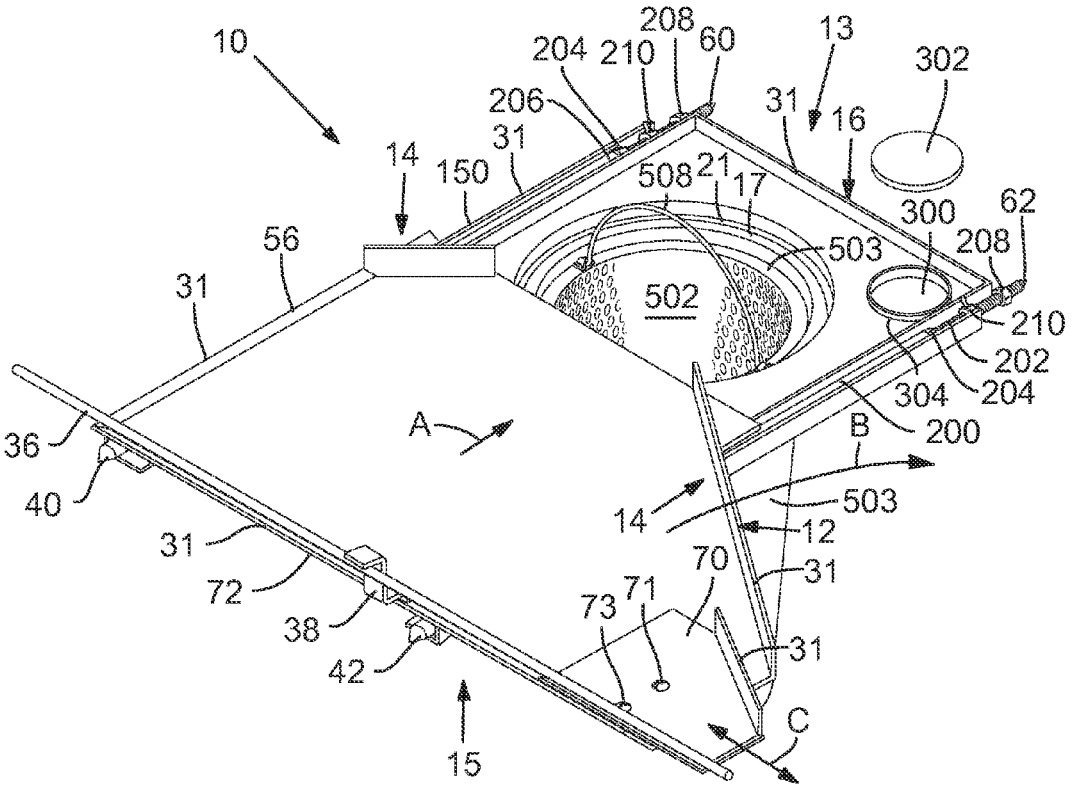
FIG. 8 is a perspective view showing the components of FIG. 7 in an assembled condition.
Figure 8A:
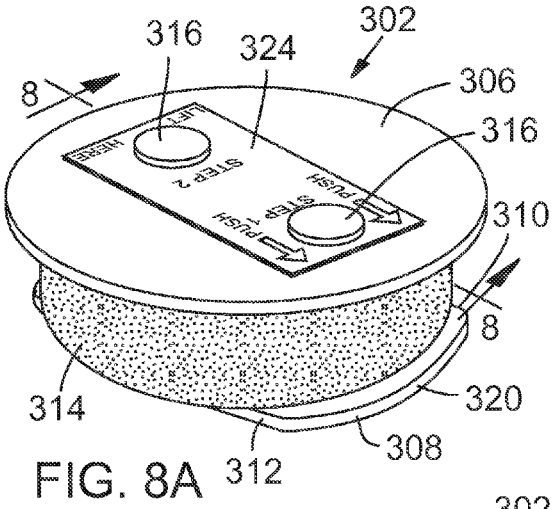
FIG. 8A is a perspective view showing the cap that is used to plug the access port in the apparatus of the present invention.
Figure 8B:
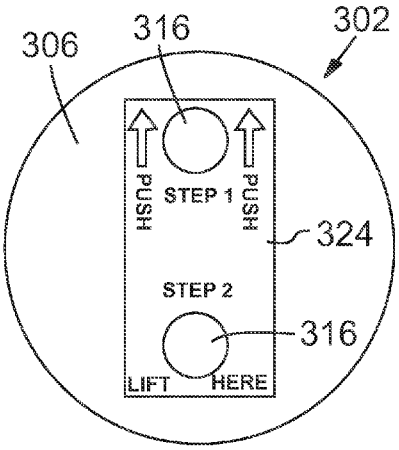
FIG. 8B is a top plan view of the cap shown in FIG. 8A.
Figure 8C:
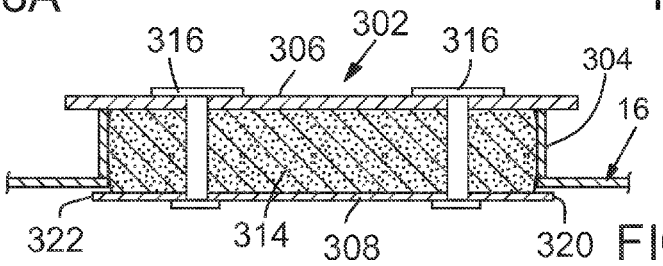
FIG. 8C is a cross sectional view taken along the line 8-8 of FIG. 8A.
Figure 8D:
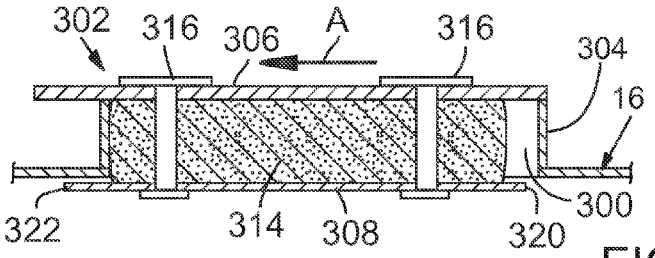
FIG. 8D is a cross sectional view taken along the line 8-8 of FIG. 8A and similar to the view of 8C except illustrating how the cap is removed from the access port.
Figure 8E:
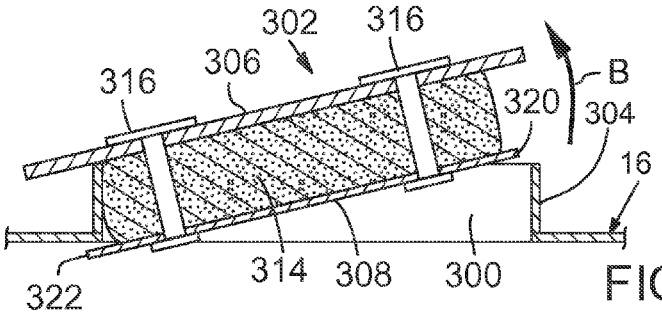
FIG. 8E is a cross sectional view taken along the line 8-8 of FIG. 8A and is a sequential view following the procedure of removing the cap as shown in FIG. 8D.

With reference to FIGS. 8C, 8D and 8E it may be seen that test port 300 is defined by a circular opening through second support plate 16 with an upwardly extending lip 304 around the opening. Cap 302 comprises an upper circular plate 306 that has a diameter that is larger than the diameter of the opening of test port 300, and a lower plate 30 that has opposite side edges 310, 312, flattened, and a dimension across the plate between rounded side edges 320, 322 (one of which is shown in FIG. 8A) that is greater than the diameter of opening of test port 300, yet slightly less than the diameter of upper plate 306. A compressible circular foam disk 314 having a diameter that is approximately equal to the diameter of port 300 is sandwiched between upper plate 306 and lower plate 308 and is held in place with, for example, through fasteners 316 (or other suitable fasteners or adhesives).

As best illustrated in FIGS. 8C, 8D and 8E, cap 302 is inserted into port 300 with upper plate 306 resting atop the upwardly extending lip 304 and the lower plate 308 extending over circular edge of plate 16 that defines port 300. In this position, the foam disk 314 seals against the interior edges of lip 304. Upper plate 306 prevents the cap 302 from being pushing through the port in the downward direction, and lower plate 308 prevents the cap from being pulled upwardly (i.e., by suction from a vacuum).

Cap 302 is removed to allow access to the interior of vault 100 as shown with arrow A in FIG. 8D and as shown with the instructions that are preferably printed atop upper plate 306 (FIG. 8B). Thus, to remove the cap 302 it is pushed horizontally as shown with arrow A. This compresses the foam disk against lip 304. When the cap 302 has been slid a sufficient distance in the direction of arrow A, the edge 320 of lower plate 308 clears the inner circumference of port 300 and this allows the cap 302 to be lifted upwardly with an angled lifting motion as shown in arrow A in FIG. 8E. An instruction sheet 324 may advantageously be adhered to upper plate 306 with instructions for removal of cap 302 and showing the motions necessary to remove it.

Figure 4:
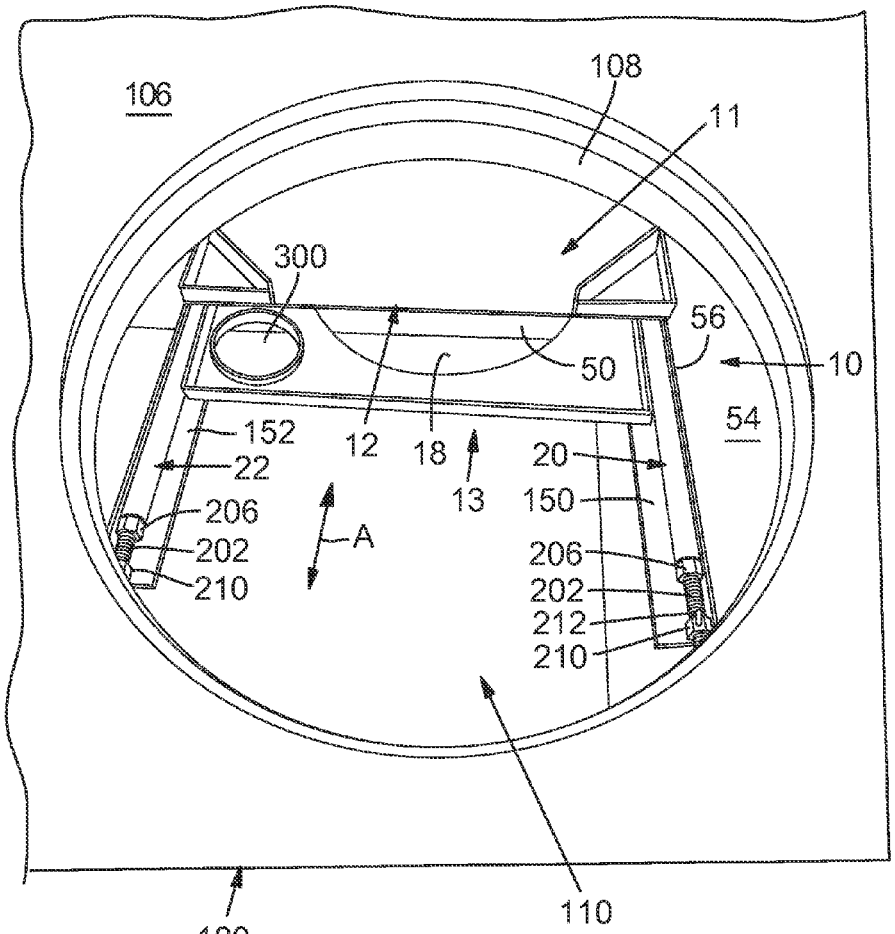
FIG. 4 is an upper perspective view taken through a manhole opening similar to FIG. 2, illustrating a portion of the filtration apparatus according to the present invention installed in the interior of the vault.

As noted, second support plate 16 is movable from a first position in which edge 13 of the plate 16 is pushed up against wall 32 as shown in FIG. 2, and a second position in which the plate 16 is retracted from wall 32 to expose the open interior 110 of vault 100 beneath support plate 11, as shown in FIG. 4. In FIG. 4 the second support plate 16 is moved partially into the retracted position. The support plate 16's outer edges are slidably supported on laterally opposed rails 150, 152, which are attached by welding to jack bolts 20 and 22, respectively. The support plate 16 is movable on rails 150, 152 back and forth in the direction of arrow A in FIGS. 4, 5 and 6.

With returning reference to FIGS. 2 and 7, the components of jack bolt 20 may be seen in a relative close up view. Stop nut 210 has a projection 212 extending outwardly from the nut, which as noted is rotatable on threaded rod 202. The stop nut 210 may be rotated in the clockwise direction in FIG. 2 so that the projection 212 prevents plate 16 from moving to the second position—projection 212 physically hits upwardly projecting lip 31 as the plate is moved in the direction of arrow A. If stop nut 210 is rotated in the anticlockwise direction in FIG. 2, the projection is rotated away from the position where it will prevent movement of plate 16, which may accordingly be moved to its retracted position.

Figure 3:
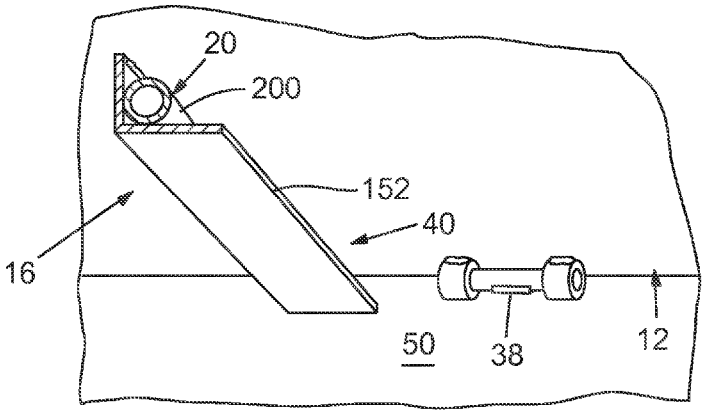
FIG. 3 is a lower perspective view taken from the interior of a vault, illustrating select components of the filtration apparatus according to the present invention.

FIG. 3 is a view of the interior 110 of vault 100 showing rail 152 and looking toward interior wall 50 of the vault. Although not visible in FIG. 3, the proximal end 40 of jack bolt 20 bears against wall 50 of vault 100 to support that side of plate 11. The structure and function of hinge 38 is detailed below.

Figure 5:
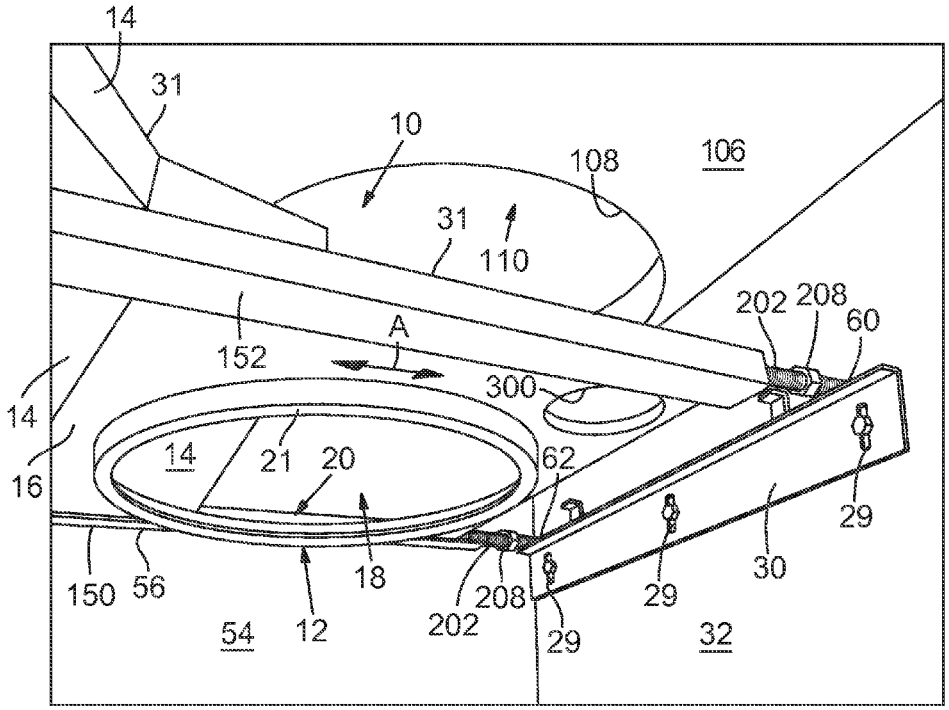
FIG. 5 is a lower perspective view taken from the interior of a vault, illustrating select components of the filtration apparatus according to the present invention.

FIG. 5 is a view taken from the interior 110 of vault 100 showing support plate 30 bolted to wall 32 and with plate 16 in an intermediate position between the retracted position and the closed position, movable in the direction of arrow A to place the plate 16 in the extended position. In FIG. 5, the distal ends 60 and 62 of the jack bolts 20 and 22 are resting on the support plate 30. Preferably, support plate 30 includes vertical channels 29 through which the attachment bolts extend so that the support plate may be leveled and adjusted as desired. As detailed below, support plate 30 defines the initial support for the end 13 of plate 11 that lies adjacent to wall 32 during installation of apparatus 10, prior to extension of the jack bolts to drive them into the wall.

Figure 6:
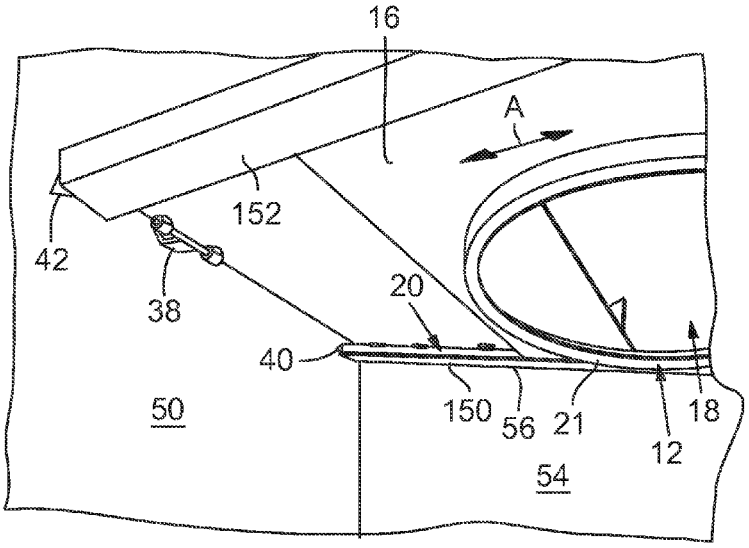
FIG. 6 is a lower perspective view taken from the interior of a vault, illustrating select components of the filtration apparatus according to the present invention, similar to FIG. 5 but showing the apparatus in a retracted position.

FIG. 6 is a view similar to FIG. 5 but showing the opposite interior wall 50 of vault 100 from that shown in FIG. 5. In FIG. 6, the proximal ends 40 and 42 of jack bolts 20 and 22 bear into wall 50 to support the apparatus 10.

Returning again to FIGS. 7 and 8, apparatus 10 includes a plate 70 that defines means for adjustment of the lateral width of plate 11. Specifically, the plate 70 is attached to plate 12 with bolts 71 and 73 that extend through adjustment channels 75 and 77 in plate 12 and an underlying plate 79. Plate 70 includes an upwardly projecting lip 31, which functions as detailed above, but which allows plate 70 to be moved laterally relative to plate 12 in the directions of arrow C in FIG. 8. It will be understood that the ability to move plate 70 allows the overall width of apparatus 10 to be varied to accommodate vaults 100 and openings 104 of differing dimensions.

Figure 10:
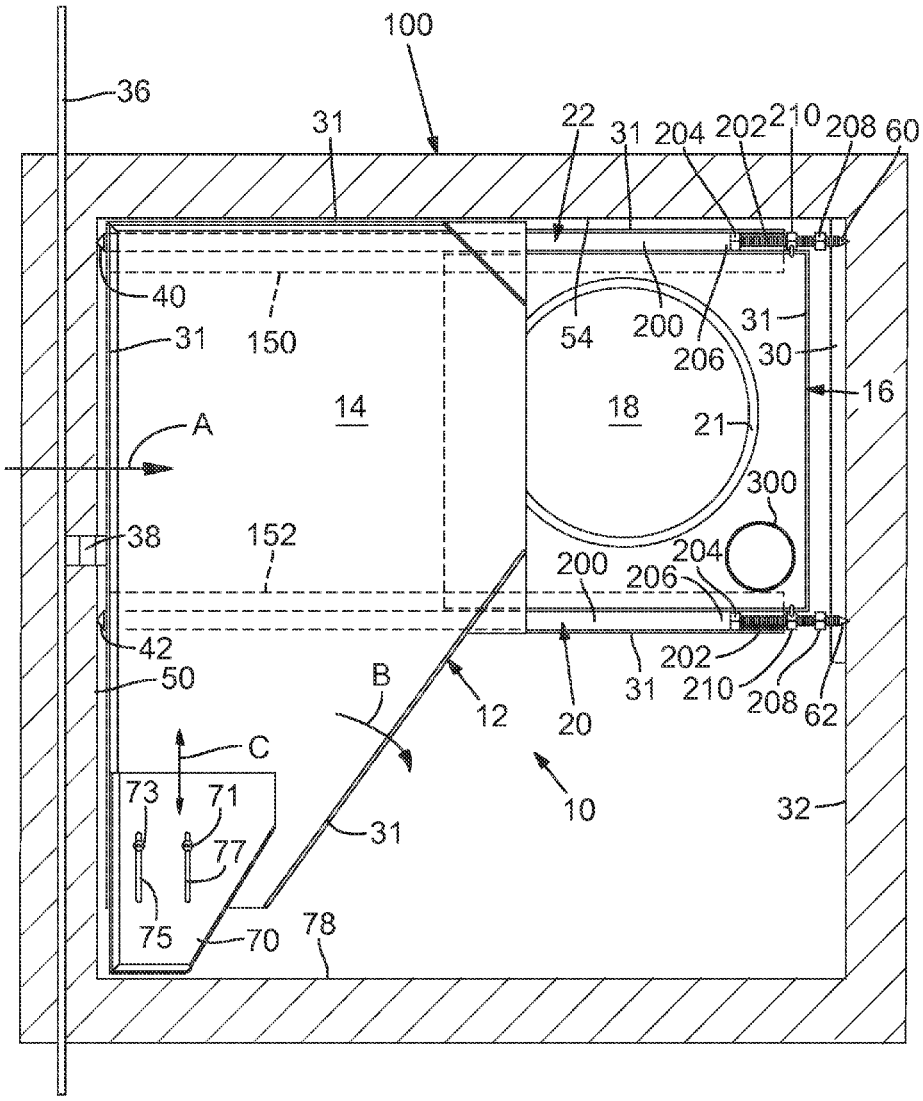
FIG. 10 is cross sectional view taken along the line 10-10 of FIG. 9, illustrating the apparatus in a nearly fully extended position.
Figure 11:
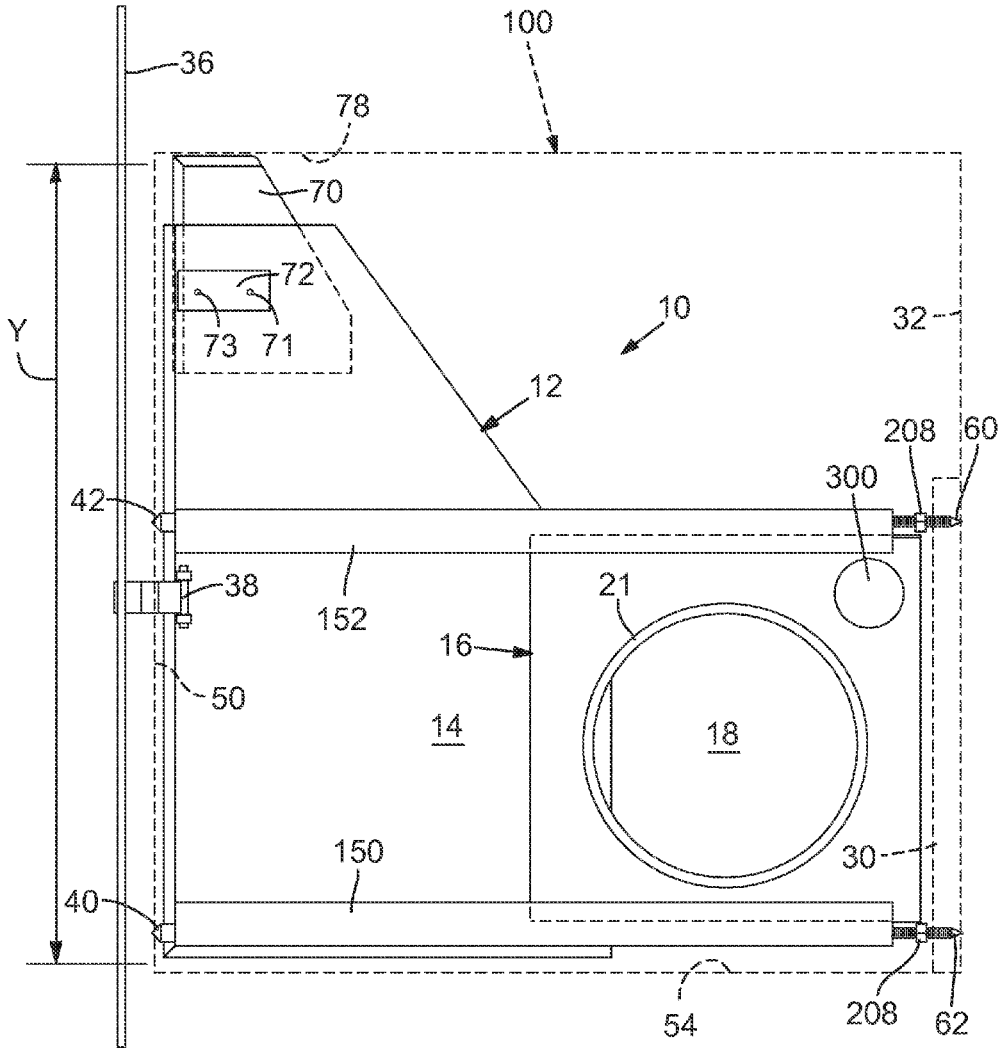
FIG. 11 is a lower perspective plan view taken from the interior of a vault and looking upwardly toward the filtration apparatus according to the present invention.

Apparatus 10 includes a mechanism that facilitates support of the end of plate 11 that abuts interior wall 50 of the vault 100—that is, edge 15—during the installation process. As noted previously, prior to insertion of the apparatus 10 into the vault interior 110 through the opening 104, a support plate 30 is attached to interior wall 32. When the apparatus 10 is initially inserted into the vault, ends 60 and 62 of jack bolts 20, 22, rest on the support plate 30 to thereby support edge 13 of plate 11 adjacent wall 32 during installation. As seen in FIGS. 7 and 8, a suspension rod 36 is attached to plate 12 with a hinge 38 that is generally S-shaped and which has one end pivotally connected to the underside of plate 14 and the opposite end attached to the suspension rod (e.g., FIG. 9). The suspension rod 36 has a length that is greater than the width of inlet opening 104 into vault 100. With reference now to FIGS. 10 and 11, because the suspension rod is longer than the width of the opening 104 into the vault, the outer lateral ends of the rod make contact with the outer edges of the vault when apparatus 10 is inserted fully into the vault (i.e., when edge 13 is supported on support 30 adjacent wall 32, and edge 15 is inside of the vault adjacent wall 50). Because hinge 38 is S-shaped, the apparatus 10 drops into the vault interior but is held in place by suspension rod 36, the outer ends of which extend past the sides of the vault opening 104.

The primary and secondary filter assemblies used in apparatus 10 and how they are suspended by plate 16, through opening 18, are illustrated in several figures, notably FIGS. 7, 8, 9 and 12.

With reference to FIG. 7, a ring 17 has circumferential inwardly and downwardly projecting shoulder 19 that is frustoconical in shape such that the diameter of the ring is greater at the upper periphery than at the lower periphery (i.e., at the bottom of the shoulder 19). Ring 17 fits into opening 18 and is supported therein with an inwardly projecting circumferential lip 21 (FIGS. 7, 8).

Filter assembly 500 is defined by a cylindrical mesh strainer basket 502, which defines the primary filter, and a secondary filter 504 (detailed below and shown in, for example, FIG. 12). Basket 502 has an upper peripheral lip 503 that is smaller in diameter than the diameter of ring 17 at its upper peripheral edge, but larger than the diameter of ring 17 at the lower edge of the shoulder 19. When ring 17 is inserted through opening 18 and suspended in place thereon, strainer basket 502 is inserted through opening 18 and the upper peripheral lip 503 rests on the inwardly projecting shoulder 19 such that the basket 502 is suspended into the open interior 110 of vault 100 under the plate 11, and such that the basket is supported and held in place by the support plate assembly. Strainer basket 502 has a downwardly extending cylindrical sidewall that extends into the interior space 110 below plate 11 such that the closed bottom of the strainer basket, which may be mesh or solid, is spaced apart from the bottom of the vault 100 (FIG. 9). Strainer basket 502 is a perforate mesh screen that has plural openings sized to filter out solid debris that flows into it. Preferably, the side wall of strainer basket 502 tapers inwardly from the top toward the bottom of the basket as illustrated, although the side wall may be vertical.

Strainer basket 502 is preferably cylindrical but can be of any shape and the size of the perforate openings in the mesh can be varied to accommodate conditions at any given site where the inventive apparatus described herein is located. As an example, if the site has a relatively large amount of small solid objects such as small rocks flowing into the system, a strainer basket 502 having perforate openings of an appropriate size can be selected and used. To facilitate easy removal of strainer basket 502 from its position in plate 16, a handle 508 is provided. Because the strainer basket of the preferred embodiment is cylindrical it has substantial surface area to volume ratio and thus has substantial filtering capacity. It can thus be used to filter out a substantial amount of debris before it becomes full or clogged. As particulate matter accumulates within the strainer the basket fills from the bottom toward the top. Water is still able to flow freely through the filter sides until it is completely full.

Figure 12:
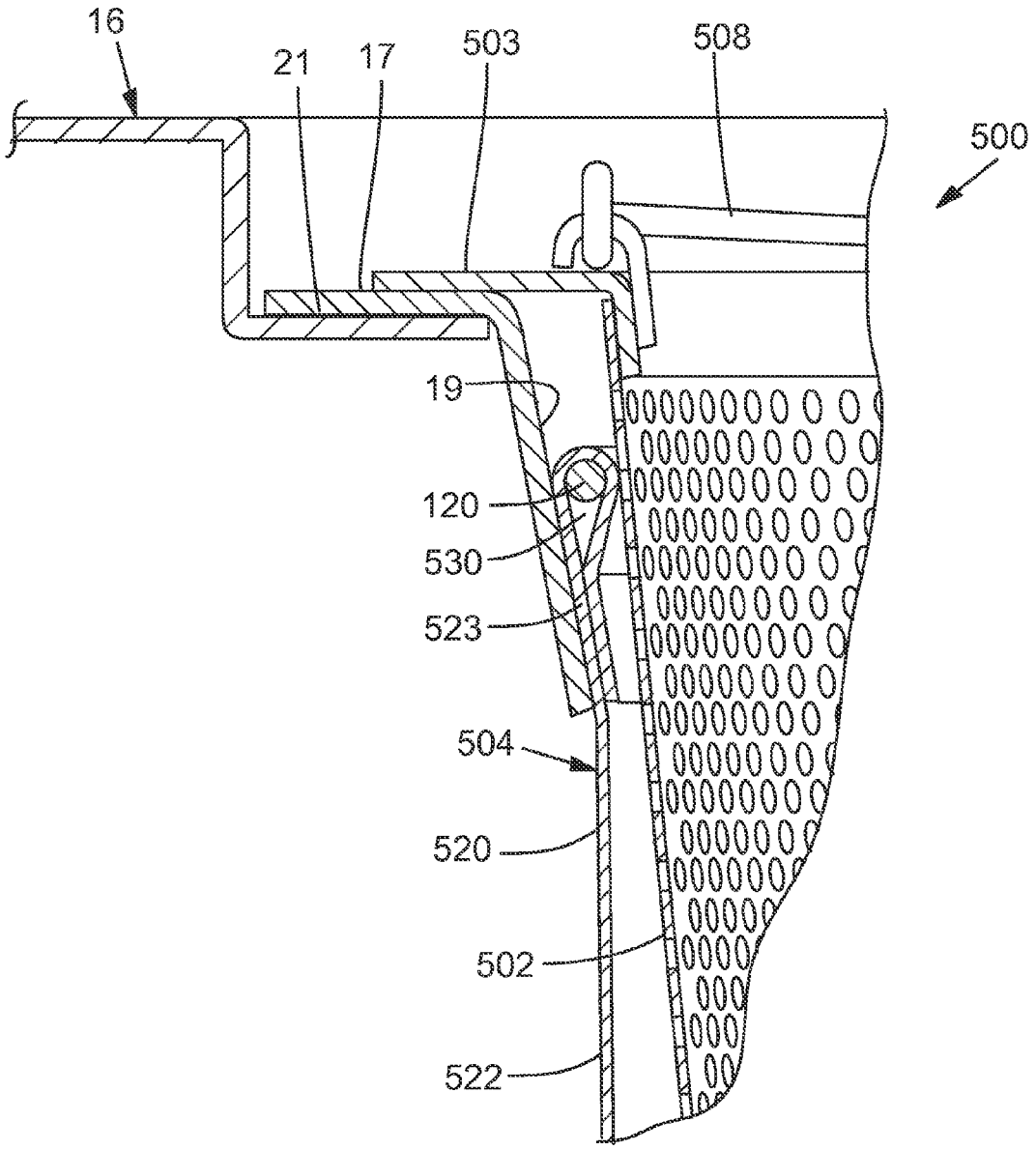
FIG. 12 is side, partial cross sectional view of the strainer basket that is used as part of the filtration apparatus according to the present invention.

With reference now to FIG. 12, an optional secondary filter 504 substantially completely surrounds the exterior surface of strainer basket 502 below plate 16. Secondary filter 504 preferably comprises a filter media 520 that is formed into a tube that encircles the outer walls of the strainer basket 502 and also the lower bottom of the strainer to substantially enclose the strainer. As such, the secondary filter 504 completely encloses the strainer basket 502. The media 520 that is used for secondary filter 504 is preferably a flexible material through which water readily flows—there are many types of non-woven and woven fabric mesh products that suffice. Preferably, the media is formed into a pocket 523 that extends around the upper edge of the media to define a circumferential loop 530 into which a ring 120 such as a flexible split metal ring is captured in the pocket 522. Secondary filter 504 is suspended through opening 18 of plate 16 by placing the metal ring within shoulder 19—the diameter of the metal ring is less than the diameter at the uppermost point of shoulder 19 yet greater than the diameter of the opening at the lowermost point of the inwardly sloping shoulder, the metal ring defines a locking ring that holds the secondary filter 504 firmly in place with the filter suspended below the upper plate 16. Filter basket 502 is inserted into the installed secondary filter 504.

A strip of flexible sealing strip 72 is optionally extended around the periphery of support plate 11, or portions of it, so that it seals against the adjacent interior walls of the vault. For example, a sealing strip 72 is shown in FIGS. 7, 8 and 9 on edge 15 of plate 14. The seal is affixed to the upwardly extending lip 31.

Installation of apparatus 10 into a vault 100 will now be described in detail. As noted previously, support plate 11 has a low profile that allows it to be inserted through inlet opening 104, which as noted may be as small as 4 inches by 48 inches. The height dimension of the support plate 11 is less than the height dimension of the inlet 104. As such, the apparatus may be installed in existing vaults that have already been placed in the ground and there is no need for workers to actually enter the vault. The installation process requires as a first step that the support plate 30 is attached to the rear interior wall 32 of vault 100. The support plate 30 may be a length of angle iron that is bolted to the wall 32 and preferably includes slotted bolt holes 29 that allow the plate to be adjustable to make sure that it is level (i.e., with slotted bolt holes defined by vertical channels 29 in the plate). The width of support plate 30 is greater than the width between jack bolts 20 and 22. The support plate 30 may be installed by workers reaching into the vault through the manhole opening 108.

With support plate 30 in place, the support plate 11 is inserted through inlet 104 with edge 13 being inserted first; edge 13 defines the leading edge in the installation process and edge 15 thus defines the trailing edge. The plate is inserted in the orientation shown in FIG. 5 and with the distal ends 60 and 62 of jack bolts 20 and 22 resting on the top of support plate 30. Typically, one worker will insert the support plate 11 through the inlet and a second worker, reaching through the manhole opening 108 will guide the support plate so that the jack bolts rest atop the support plate. When the distal ends 60, 62 of jack bolts 20, 22 are resting atop the support plate 30, edge 13 is adjacent wall 32 and the opposite edge of plate 11—identified with reference number 15, drops into the vault 110 and the entire support plate 11 is held suspended in the vault with suspension bar 36 that is hingedly attached to the lower surface of support plate 14 with hinge 38. As detailed above, the width of suspension bar 36 is greater than the width of inlet 104 and as such, the outer edges of the suspension bar catch on the outer edges of the inlet 104, preventing the support plate 11 from dropping into the open interior 110 of the vault 100, and suspending the support plate 11 in the vault. Thus, if the width of inlet 104 is 48 inches, the length of the suspension bar 36 would be in the range of 56 inches (although this is variable so long as the length of the suspension bar is greater than the width of the inlet opening), enough overlap on each side of the bar that the catches on the edges of the inlet opening.

In this position, with the support plate initially located in the interior of the vault, the proximal ends 40, 42 of jack bolts 20 and 22 lie close to the interior wall 50 of vault 100. The plate 110 is adjusted so that it is level and edge 54 is tight against the edge 56 of the vault (and seal 72 is sealed against the wall), and the jack bolts 20 and 22 are tightened. This drives the jack bolts to extend them longitudinally, driving the distal ends 60, 62 into wall 32 and the proximal ends 40, 42 into wall 50, thereby securing the plate tightly in the vault.

Plate 70 defines a lateral width adjustment plate that defines the means for adjusting the width of plate 12 to the desired width. Plate 70 is adjustably attached to first plate section 12 so that the plate 70 may be slid laterally in the directions of arrow C in FIG. 8. It will be evident that the adjustment plate 70 is moved laterally to accommodate vaults having different widths; in use, it is moved outwardly so that it is tight against the adjacent interior wall of the vault and is tightened in place. With the support plate installed, the filter assembly is inserted through manhole opening 108 into opening 18 in plate 16.

The plate 70 is adjusted in its position in vault 100 so that water flows onto the plate 14 across the entire width of opening 104. Water flowing onto plate 14 flows directly into opening 18. As such, it may be desired to angle the support plate 11 at a slight downward angle relative to the ground plane and toward opening 18—this defines a downwardly sloping flow path from the edge 15 of the plate toward edge 13 toward the back wall 32 of the vault.

As noted previously, the apparatus may be installed in an existing vault without the need for workers to ever enter the vault itself; all work may be done from the outside of the vault. This is a significant improvement in ease of work, efficiency and safety for the workers.

It will be appreciated that the present invention not only allows for installation without workers entering the vault, but also allows the vault to be cleaned without workers entering the vault. Specifically, to clean the vault the filter basket 502 and secondary filter 504 are removed by lifting them upwardly through the manhole opening 108. The retractable second plate section 16 is then moved into its retracted position (i.e., the position in FIG. 4) to thereby expose the open interior 110 of vault 100. Suction cleaning equipment such as a Vactor truck may then be used to clean the interior of the vault.

The invention allows workers using a Vactor truck, a jetter truck, a camera truck and similar equipment to maintain and inspect the interior of the vault without having to remove the filter device and without requiring personnel to enter the confined space of the vault; all necessary installation, servicing and inspection may be done from outside the vault. The device has a primary and secondary filtration system and a testing port 300 which will allow testing of incoming water, and all work may be done by simply removing the manhole cover.

While the present invention has been described in terms of a preferred embodiment, it will be appreciated by one of ordinary skill that the spirit and scope of the invention is not limited to those embodiments, but extend to the various modifications and equivalents as defined in the appended claims.

The invention claimed is:

1. A filter system for use with an existing in-ground vault having an inlet opening having a height dimension X, a width dimension between opposed edges of the inlet opening Y, and a vault interior having interior walls including a first interior wall nearest said inlet opening and a second interior wall opposite the first interior wall, comprising:

a plate having a height dimension less than X and a width dimension less than Y;

plate support means for fixing said support plate in the vault interior, said plate support means comprising a support plate suspension bar attached to an edge of said plate that is adjacent said first wall, said suspension bar having a length dimension greater than Y;

at least a primary filter suspended from said plate and extending through a filter opening in said plate, said primary filter installable through said filter opening after said support plate is fixed to said vault interior.

2. The filter system according to claim 1 wherein the plate further comprises a first plate section and a second plate section that is movable between a first extended position and a second retracted position.

3. The filter system according to claim 2 wherein said filter opening is in said second plate section.

4. The filter system according to claim 3 wherein said second plate section may be moved from the first extended position and said second retracted position when said primary filter is suspended therefrom.

5. The filter system according to claim 2 wherein the width the plate is defined by the first plate section and the width of the first plate section may be increased and decreased.

6. The filter system according to claim 1 wherein said plate support means comprises first and second extendable jack bolts attached to said plate and having proximal and distal ends adapted for bearing against opposed interior walls of said vault.

7. The filter system according to claim 6 including a support ledge attached to the second interior wall for at least initially receiving said distal ends of said first and second extendable jack bolts.

8. The filter system according to claim 7 wherein the suspension bar has opposed opposite ends that overlap the opposed edges of the inlet opening.

9. The filter system according to claim 8 wherein when said plate is inserted through said inlet opening and said distal ends of said first and second extendable jack bolts are received on and supported by said support ledge, said edge of said plate that is adjacent said first wall of said vault is supported in said vault interior by said suspension bar.

10. The filter system according to claim 5 wherein the first plate section includes an adjustment plate that may be moved relative to the first plate section to selectively increase or decrease the width of the first plate.

11. The filter system according to claim 10 wherein the adjustment plate may be moved to a position where the width of the first plate is greater than Y.

12. The filter system according to claim 1 including an access port in the plate having a diameter and a removable cap covering the access port, wherein said cap is defined by an upper plate having a diameter greater than the diameter of the port, a lower plate having a first diameter greater than the diameter of the port and a second dimension that is less than the diameter of the port, and a compressible material between the upper and lower plates.

13. The filter system according to claim 12 wherein the access port is a circular opening having an upwardly extending lip around the opening, said lip having a height, and wherein the distance between the upper and lower plates of said cap is greater than height of said lip.

14. The filter system according to claim 13 wherein when the cap is inserted into said port, said upper plate of said cap rests on said lip and said lower plate of said cap underlies said plate at the portion of said lower plate having the first diameter that is greater than the diameter of the port.

15. A method of installing a filter system into an existing in-ground vault having an inlet opening having a width Y defined by the distance between opposed inlet opening edges, and a vault interior having opposed first and second vault walls, comprising the steps of:

a) inserting a filter support plate through said inlet opening;

b) supporting a leading edge of said support plate on the first of said opposed vault walls;

c) supporting a trailing edge of said support plate adjacent the second of said opposed vault walls with a suspension bar attached to the trailing edge and located exteriorly of the vault interior, the suspension bar having a length between opposed ends of the suspension bar greater than Y, and wherein the respective ends of the suspension rod overlap the respective inlet opening edges; and d) fixing said support plate to said vault interior.

16. The method according to claim 15 including the step of increasing a width of said filter support plate after said support plate has been fixed to said vault interior.

17. The method according to claim 16 wherein the support plate defines a first fluid flow path from the inlet opening to said support plate and through said filter, and a second fluid flow path from the inlet opening to said support plate and into said vault interior bypassing said filter.

18. The method according to claim 16 including the step of cleaning the vault interior beneath said support plate without removing said support plate.

19. The method according to claim 18 wherein a filter is suspended from a first portion of said support plate, and including the step of sliding the first portion of said support plate with said filter relative to a second portion of said support plate to thereby expose said vault interior.

20. The method according to claim 19 including the step of cleaning said vault interior through a manhole opening.

* * * * *